US008167457B1

(12) United States Patent
Collias et al.

(10) Patent No.: US 8,167,457 B1
(45) Date of Patent: May 1, 2012

(54) LIGHTING SYSTEM FOR USE IN MOTION PICTURE AND VIDEO PRODUCTION

(75) Inventors: James H Collias, Hillsboro, OR (US); Charles H Collias, Chelmsford, MA (US); Nicholas J Forster, Simi Valley, CA (US)

(73) Assignee: Zylight LLC, Hillsboro, OR (US)

( * ) Notice: Subject to any disclaimer, the term of this patent is extended or adjusted under 35 U.S.C. 154(b) by 919 days.

(21) Appl. No.: 11/423,443

(22) Filed: Jun. 11, 2006

(51) Int. Cl.
*F21S 4/00* (2006.01)
*F21V 21/00* (2006.01)

(52) U.S. Cl. ..... 362/249.05; 362/249.03; 362/800

(58) Field of Classification Search ..... 362/294, 362/231, 230, 233, 234, 249.02, 249.03, 362/249.05, 249.12, 249.13, 800
See application file for complete search history.

(56) References Cited

U.S. PATENT DOCUMENTS

| | | | | |
|---|---|---|---|---|
| 4,947,291 | A * | 8/1990 | McDermott | 362/19 |
| 5,634,711 | A * | 6/1997 | Kennedy et al. | 362/119 |
| 5,752,766 | A * | 5/1998 | Bailey et al. | 362/249.04 |
| 6,948,823 | B2 | 9/2005 | Pohlert et al. | |
| 6,964,501 | B2 * | 11/2005 | Ryan | 362/294 |
| 7,293,898 | B2 * | 11/2007 | Kumthampinij et al. | 362/294 |
| 7,520,634 | B2 * | 4/2009 | Ducharme et al. | 362/276 |
| 7,521,872 | B2 * | 4/2009 | Bruning | 315/158 |

* cited by examiner

*Primary Examiner* — Jason Moon Han
(74) *Attorney, Agent, or Firm* — J. Douglas Wells

(57) ABSTRACT

An illumination system suitable for lighting in connection with the production of film or video includes one or more lighting modules, wherein each module contains a light engine, a heat sink to which the light engine is affixed, and a control system electrically connected to the light engine, the control system capable of adjusting both the color and intensity of light engine by means of one or more rotary concentric control knobs and pushbuttons affixed to the control system, and wherein the control systems of each module are interconnected by a wireless data network, so that all of the modules may be controlled by using the rotary control unit on any individual module.

11 Claims, 5 Drawing Sheets

LIGHTING SYSTEM FOR USE IN MOTION PICTURE AND VIDEO PRODUCTION

CROSS-REFERENCE TO RELATED APPLICATIONS

None.

BACKGROUND OF THE INVENTION

This invention relates to lighting systems, and more specifically to systems intended to illuminate motion picture sets and sets of video productions.

The problem of finding the proper illumination for images goes back to the beginning of the visual arts. Long before the advent of photography artists were concerned, even obsessed, with the effect of light on the subjects of their artistic endeavors. Artists traveled over long distances to view the effects of natural light during different times of day, under different cloud conditions, in different latitudes.

During the early days of photography the low sensitivity of early photographic films required a fairly high lighting intensity. In the mid 19th century, OSCAR GUSTAVE REJLANDER, a Swedish painter turned photographer, is said to have used a cat as a primitive exposure meter by placing the cat next to his subject. By looking at the cat's eyes he could tell whether the lighting conditions were proper for photographing his subject.

The first use of artificial light in photography is attributed to L. Ibbetson, who, in 1839, used oxy-hydrogen light when photographing microscopic subjects.

Later photographers used magnesium powder as a source of illumination (flash powder). Magnesium ribbon later replaced powder, and was electrically ignited in flash bulbs. See, for instance, U.S. Pat. No. 3,319,058.

Professional still photography as well as motion picture photography have managed the intensity problem by simply adding more lights to illuminate the subject. Although modern technology has produced light-generating systems with adjustable luminous intensity, the method of adding lights still remains a popular method of controlling both the light intensity, and of illuminating separate parts of the subject differently.

Lighting in connection with photographic images soon became a matter of both intensity and hue. Colors filters became common to further control the appearance of the subject. An example of a motion picture camera with a built-in color conversion filter appears in U.S. Pat. No. 4,033,346.

The present invention incorporates a number of technological improvements into the art of lighting for motion picture and video production. The invention is in the form of an array of lighting modules, electrically interconnected by a wireless network, allowing, at a single location, the adjustment of the light intensity and hue of each module.

The present invention utilizes a single light engine, which contains multiple LEDs in an extremely compact form. This embodiment is much cheaper and easier to manufacture and use than the alternative, that is, the mounting of many individual LEDs.

Furthermore, this invention includes a vastly simplified form of wireless networking: Other lighting systems in the prior art have been networked, but these prior art systems usually involved cables, as well as the requirement for separate addressing of the other systems, and requiring complex protocols, such as DMX®. Other prior art lighting systems have been found which utilize wireless control. However, these prior art systems can be controlled one light at a time, and further require a dedicated remote to control each such light.

Finally, the rotary color adjustment of the present invention brings a new level of convenience and simplicity of operation to the technology. The prior art control systems have all required the management of multiple buttons, in a complex sequence, to attempt to control the lighting hue. Each module has the capability of adjusting both luminous intensity and hue. Despite their technological complexity, the modules are user-friendly, having analog-like concentric control knobs and push button switches.

BRIEF SUMMARY OF THE INVENTION

It is an object of the present invention to provide an array of lighting modules for use in connection with motion picture and video production.

It is a further object of the invention to provide such an array in which each module has a high-intensity light source, with control of luminous intensity and hue.

It is a still further object of the invention to provide such an array which is wirelessly interconnected, so that control of the array may be exercised at a single location.

In accordance with a first aspect of the invention an illumination system suitable for lighting in connection with the production of film or video includes one or more lighting modules, each module having an array of lighting elements as its light source.

In accordance with a second aspect of the invention, the array of lighting elements is embodied as a high-luminous-intensity light engine.

In accordance with a third aspect of the invention the light source is mounted directly to a heat sink.

In accordance with a fourth aspect of the invention a control system capable of adjusting the intensity of light engine is electrically connected to the light source by means of one or more rotary concentric control knobs.

In accordance with a fifth aspect of the invention the control system is further capable of adjusting the hue of the light source that is electrically connected to control circuitry by means of one or more rotary concentric control knobs.

In accordance with a sixth aspect of the invention the control system of each module is interconnected with that of all the other modules by a wireless data network.

In accordance with a seventh aspect of the invention all of the modules are controlled by using the rotary control unit on any individual module.

In accordance with an eighth aspect of the invention the interconnected modules make up a group wherein an additional module may be added to the group by depressing a single pushbutton for a connection period, and then releasing the pushbutton.

In accordance with a ninth aspect of the invention all of the modules of the group are controlled by using the control system of any individual module.

In accordance with a tenth aspect of the invention means are also provided for adjusting the hue of the light produced by the light source.

In accordance with an eleventh aspect of the invention the control system of each module further contain one or more pushbuttons preset to hue parameters of the module.

In accordance with a twelfth aspect of the invention each module provides both a white mode and a color mode.

In accordance with a thirteenth aspect of the invention, when a module is in color mode, a rotary control will allow a user to select every visible combination of red, green, and blue by continually rotating the control in the same direction.

In accordance with a fourteenth aspect of the invention the control system allows the addition of various intensities of white to a selected combination of red, green and blue, thus producing pastel colors.

In accordance with a fifteenth aspect of the invention means are provided to detect the temperature of the light engine, and means are further provided to adjust the light engine's output based on this temperature.

In accordance with a sixteenth aspect of the invention the hue parameters of each pushbutton have a first value when the module is in a white mode, and a second value when the mode is set to color mode.

In accordance with a seventeenth aspect of the invention the control system is separated from the heat sink by a distance of at least 2 cm, to facilitate adequate thermal isolation.

In accordance with an eighteenth aspect of the invention the light engine is approximately 26.7 mm in width by 31.8 mm in height, and the heat sink is approximately 5 cm in width by 5 cm in height.

BRIEF DESCRIPTION OF THE SEVERAL VIEWS OF THE DRAWINGS

These, and further features of the invention, may be better understood with reference to the accompanying specification and drawings depicting the preferred embodiment, in which.

DETAILED DESCRIPTION OF PREFERRED EMBODIMENTS

Figure 2:
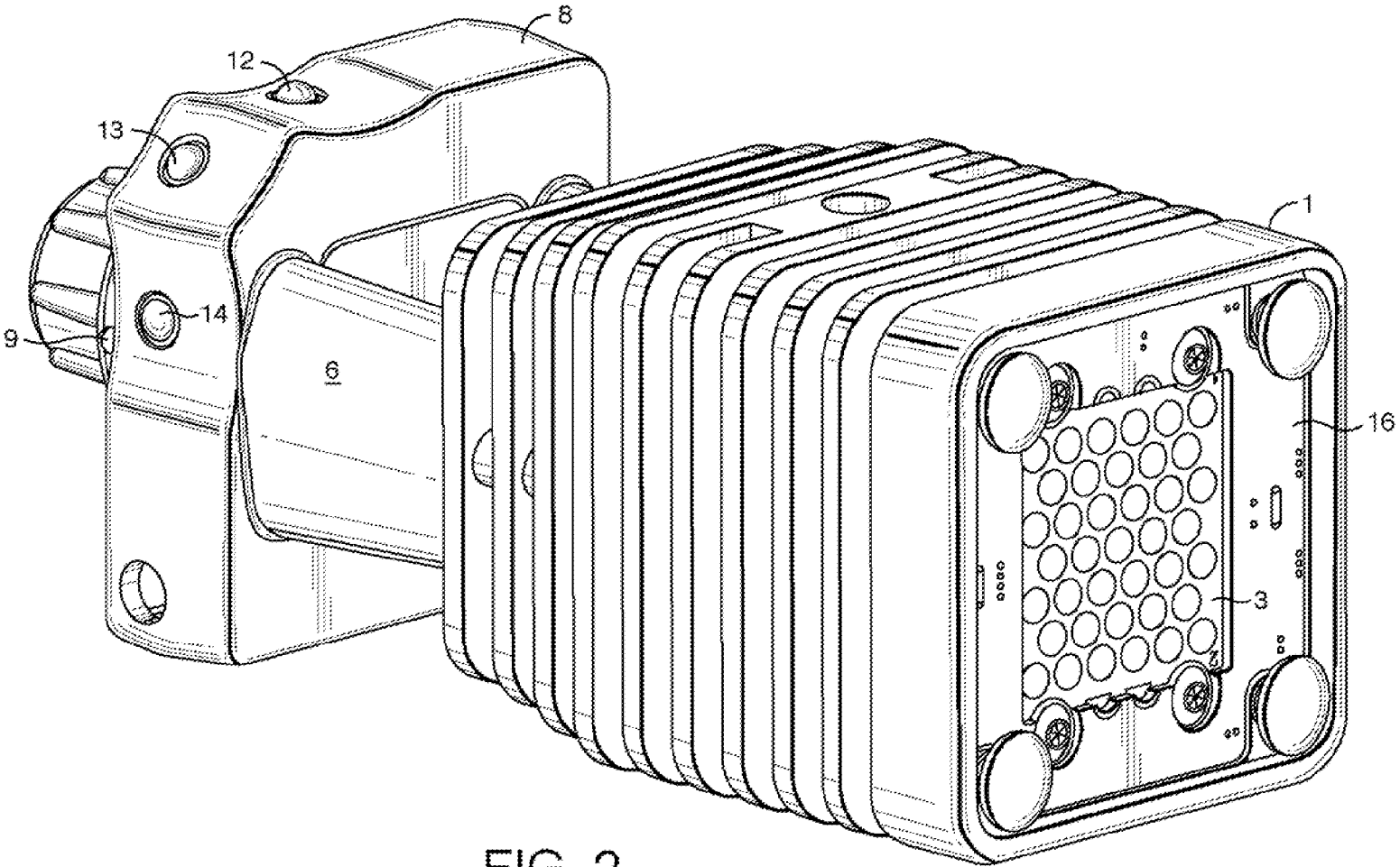
FIG. 2 depicts a perspective view of the module viewed from the front/side.
Figure 3:
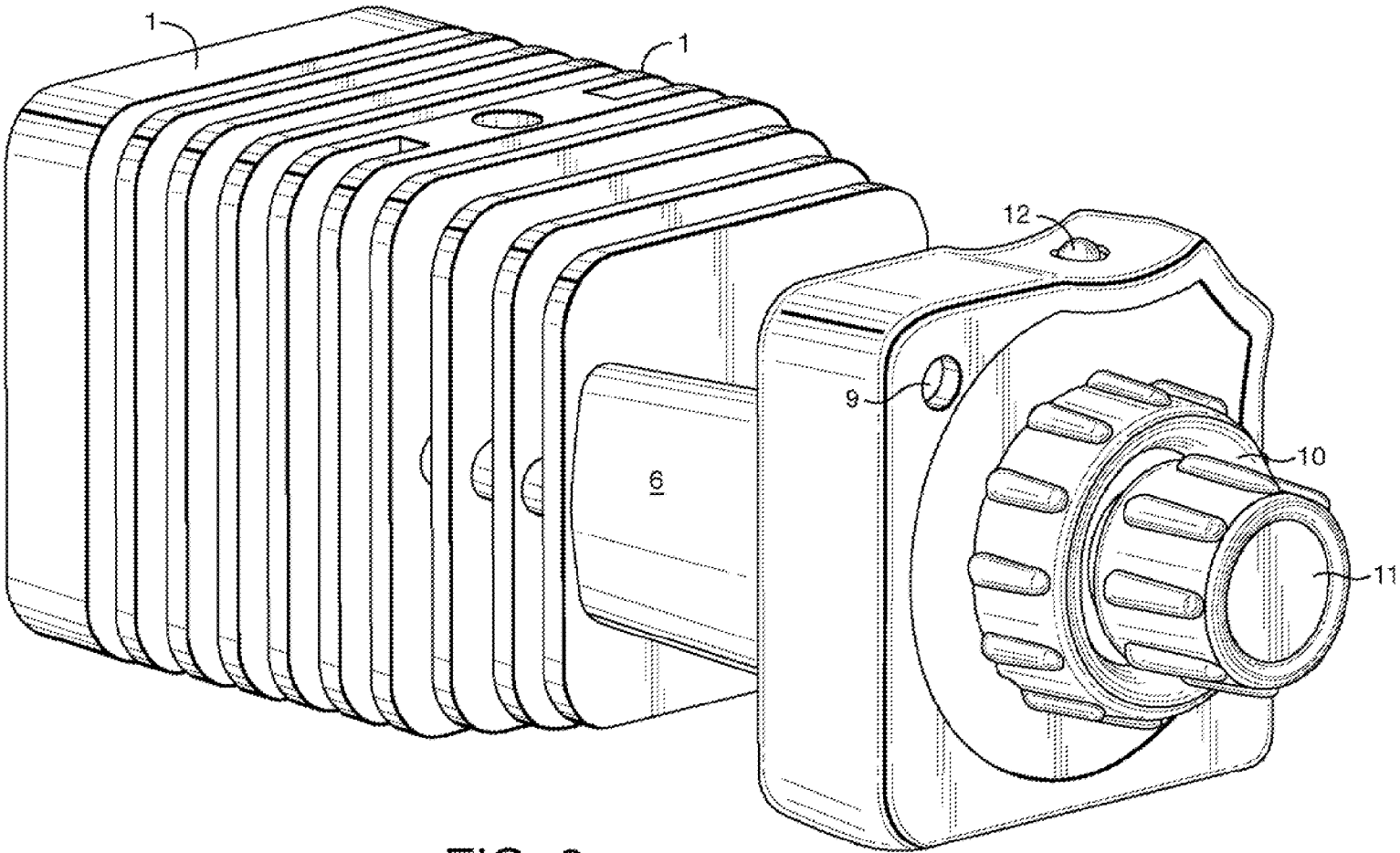
FIG. 3 depicts a perspective view of the module viewed from the rear/side.

The module which is the basis of the system of the present invention may be understood by first referring to FIGS. 2 and 3. These figures show a perspective view of the light module from the front and rear corners, respectively. FIG. 2 shows the light engine 3, mounted on the heat sink 1 by means screws. A light engine connector board 16, which contains a cutout through which the light engine is seen, is electrically connected to the light engine by solder connections.

The light engine chosen for the preferred embodiment is model BL-3000 manufactured by Lamina Ceramics, Inc., of Westhampton, N.J. The light engine is configured with 39 cavities, shown in the figure as circles. Each of these cavities is populated with multiple LEDs. Light distribution is a 125 degree Lambertian radiation pattern. This unit will deliver 570 lumens in 5500° K white light. The unit chosen for the preferred embodiment is a RGB unit, which provides a full spectrum of different colors.

Figure 1:
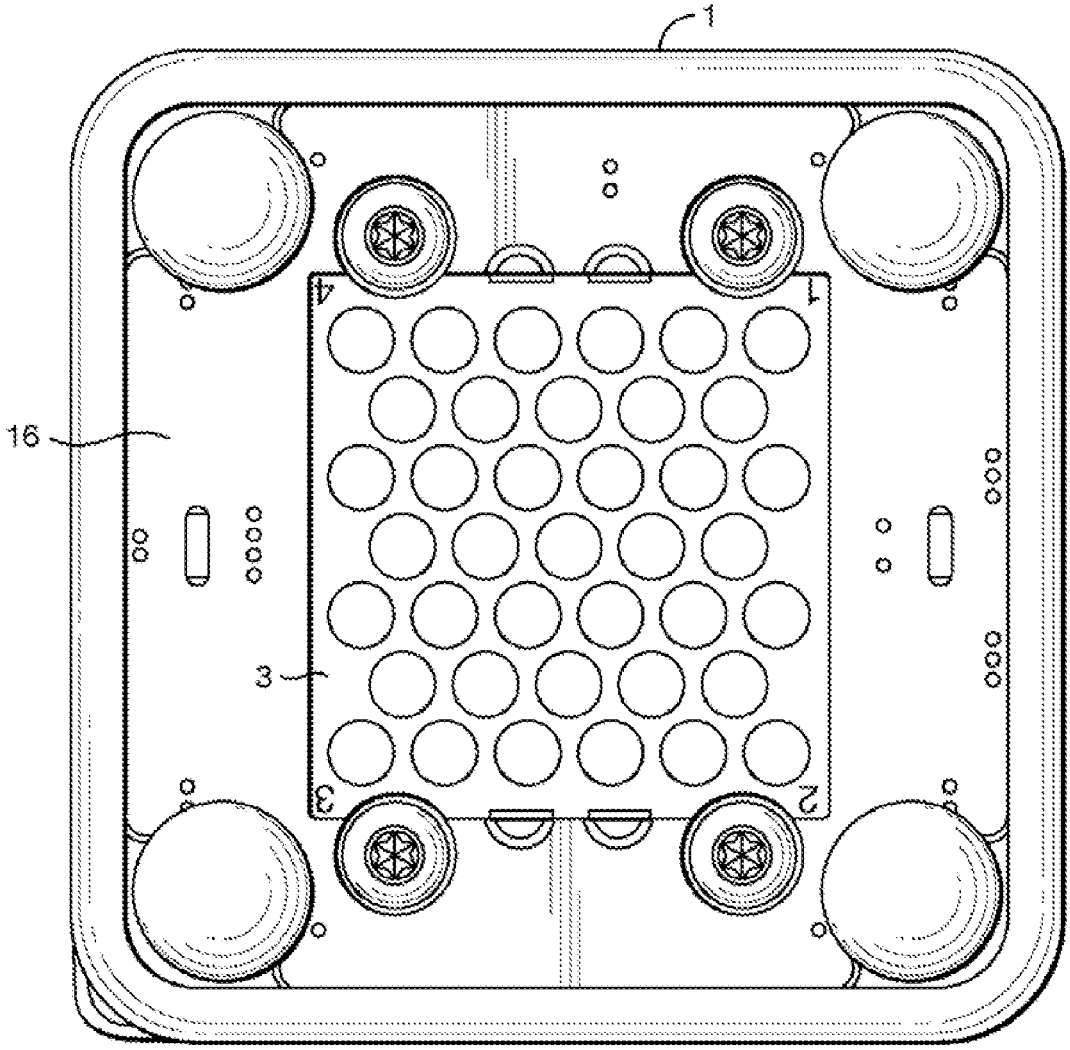
FIG. 1 depicts a front elevation view of the module.

This light engine is 26.7 mm in width by 31.8 mm in height, and is 2.3 mm thick. The heat sink 3 in which the light engine is mounted is approximately 5 cm square, as viewed from the front, as in FIG. 1. The thermal interface, having about the same width and height as the light engine 3, provides for good thermal conductivity between the light engine and the heat sink. The light engine connector board 16 attached to the light engine by solder connections.

The length of the module is about 13 cm, as measured between the face of the small knob 11 to the front of the heat sink 1. These dimensions demonstrate the compactness of the module, which is of great benefit in ease of handling. It is believed that the prior art does not disclose any modules with the capability of the present invention, while still maintaining the compactness of the present module. The design objectives used in the design of this module established these dimensions within plus or minus ten percent.

The heat sink 1 is seen to consist of a number of fins affixed to a central core 20. The heat sink is the main structural unit of the module, and it supports the rest of the module. The other components of the module are attached to the rear of the heat sink, and can be best described while viewing FIG. 5 in addition to the previously referenced figures.

With reference to this figure, the control circuitry, for the module, in the form of a control board 7, is located in an electronic enclosure which is formed from a top enclosure 8 and a bottom enclosure 6 which fit together to enclose the control board. The bottom enclosure 6 has two standoffs integrally formed beneath, which maintains a spacing of approximately 2 cm between the electronics enclosure and the heat sink, and thus thermally isolates the control board from the heat sink. It is believed that a minimum of 2 cm is required to prevent the heat from the light engine from damaging the control circuitry in the after part of the module.

A pair of conduits 5 passes from the electronics enclosure bottom 6, through the standoffs, and through the heat sink 1. Electrical connections between the light engine 3 and the control board 7 are made by means of this conduit. In the preferred embodiment, printed circuit boards or printed cables provide the electrical connections between the control board and the light engine.

Figure 5:
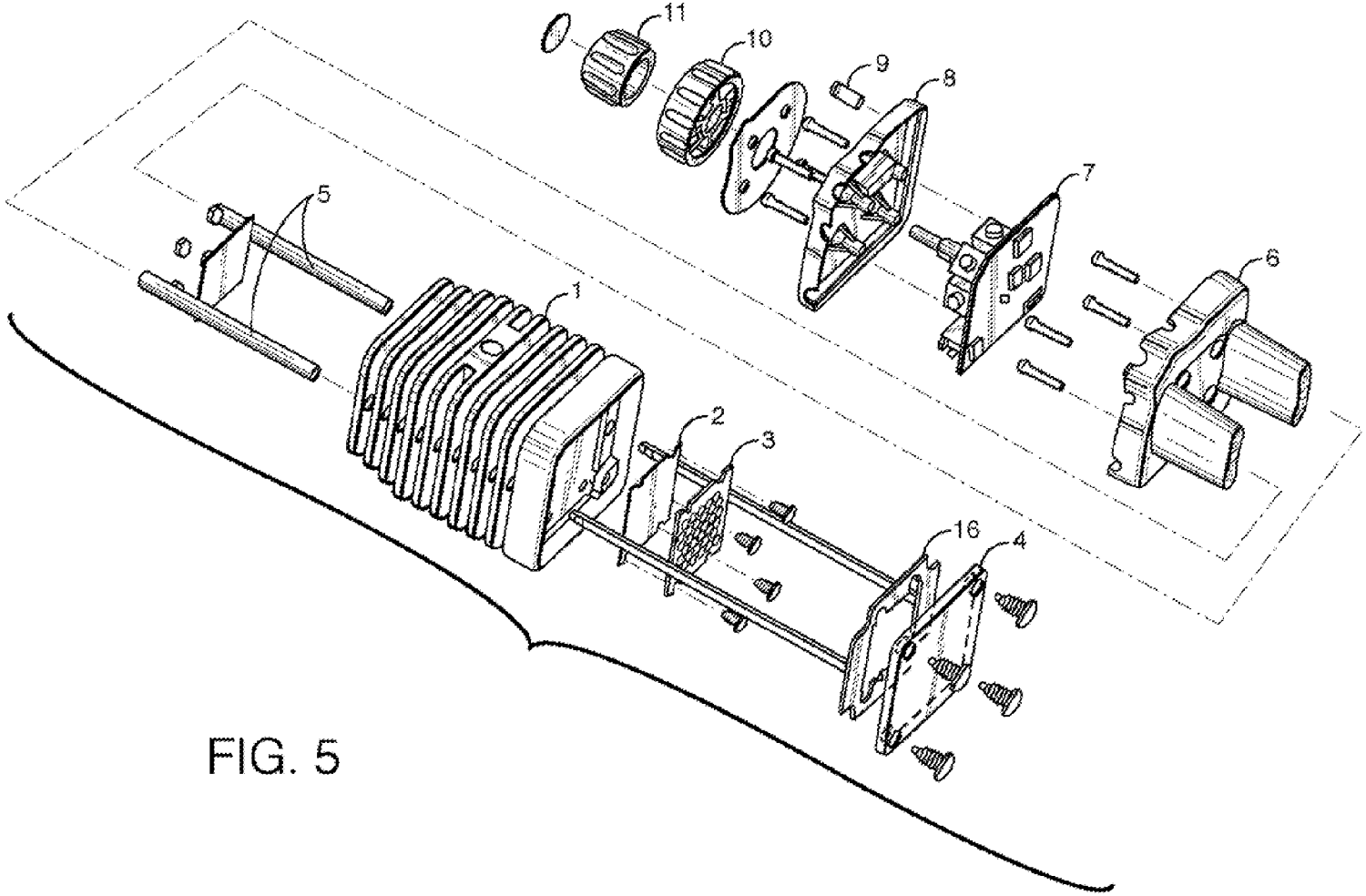
FIG. 5 depicts an exploded view of the module, showing the individual components thereof.

Still referring to FIG. 5, it is seen that the shaft of the control board 7 passes through the electronics enclosure top 8 and thus through the intensity control knob 10 and the color control knob 11. This shaft has two concentric sleeves, one of which mates with each of the knobs. An indicator window 9 allows an indicator light, located on the control board, to be visible through the electronics enclosure top 8.

Figure 4:
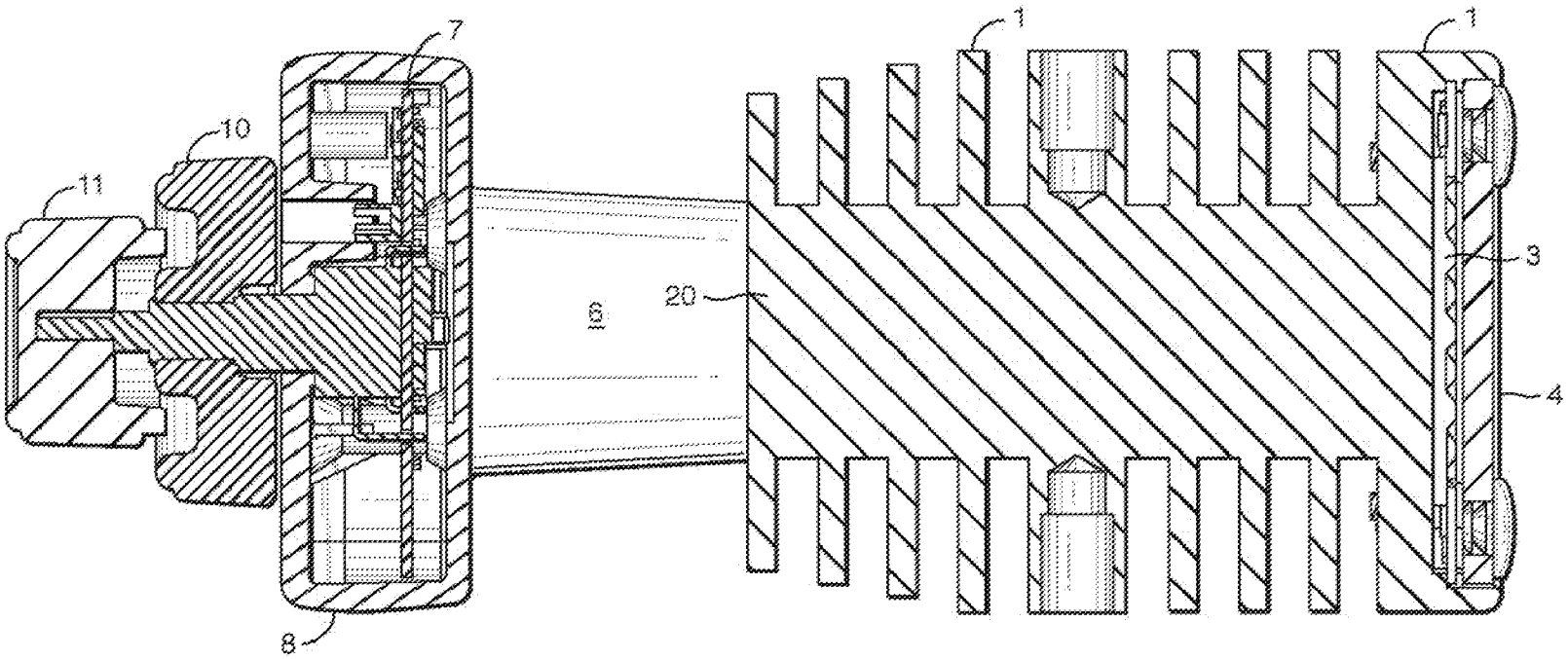
FIG. 4 depicts a cross-sectional view of the module.

Referring next to FIG. 4, a side cross-sectional view of the module is shown. The different diameters of the shaft of the control board are apparent as the shaft passes through the color control knob 11 and the intensity control knob 10. The color control knob also acts as a push button control, being spring loaded to return to its normal (out) position when released. This knob acts as a bi-stable control to command the hue to white when other hues were previously in effect.

The distance between the standoffs of the electronics enclosure bottom 6 and the heat sink 1 are clearly visible in this figure.

Several other controls of the module may be seen by referring again to FIG. 2. Pushbuttons 12 (P1), 13, and 14 (P2) are seen in this figure, located at the periphery of the electronics enclosure.

Operation of the Controls

As previously stated, the present invention has the capability of adjusting both light intensity and hue, and does so in an extremely user-friendly way.

Intensity is controlled by the larger rotary knob 10 which is rotated clockwise to increase intensity, and is rotated in the anti-clockwise direction to decrease intensity.

Pushing small knob 11 in and holding it there for about one second switches modes between color and white mode. The indicator 9 will glow white when white mode is selected and blue when color mode is selected. Rotating the smaller knob 11 changes the hue continuously as the small knob is rotated while in color mode.

The light engine used in the present invention is the RGB variety. That is, six individual LEDs are located in each of the 39 cavities of the light engine, two of each color. Each color is individually controllable on the light engine. Thus, by controlling the intensity of the Red LED separately from the Blue LED and separately from the Green LED in a particular cavity, each cavity can produce any color desired, at any intensity, within the limits of the LEDs.

The continuous hue control with continuous rotation of the small knob is effected by first having one of the basic colors (Blue, for example) at maximum intensity, and increasing the intensity of the next basic color (Red, for example) while maintaining Blue intensity. In the following example, the small knob is always rotated in the same (clockwise, e.g.) direction.

In this example, as the small knob is first rotated, Red continuously increases, while Blue remains at its maximum intensity. During this step the resulting colors are shades of violet.

After the intensity of Red has reached its maximum, the intensity of Blue begins to decrease until it reaches zero, while the intensity of Red remains constant. Thus, additional shades of violet are produced. After reaching zero, Blue remains at zero until the next cycle. When Blue reaches zero, the light engine is entirely Red. Thereafter, additional rotation of the small knob will result in an increasing intensity of Green from zero while maintaining the intensity of the Red, producing still different shades, etc. When Green reaches maximum intensity, Red is then decreased until reaching zero, while maintaining Green intensity. When Red reaches zero, the light engine is entirely Green.

The process proceeds for an entire cycle, at which time Blue is again introduced, starting at zero intensity, and increases proportionally to the relative rotation of the small knob. Thus, by this implementation, the user may rotate the small knob until the desired color is attained, since all the colors of the spectrum are available as combinations of blue and red, red and green, and green and blue.

Once a desired hue is attained, the user may increase or decrease the intensity without changing the hue by rotating the large knob 10 without moving the small knob 11.

After selecting the White mode by depressing the small knob 11, the user may select one of two preset variations of the color white by use of the two pushbuttons 12 and 14, as may be seen by referring again to FIG. 2. Pushbutton 12 is preset to 3200° K white, while pushbutton 14 is preset to 5600° K white.

These pushbuttons also function as different presets when in color mode. Setting these pushbuttons to particular hues is a procedure similar to that of setting a preset key to a particular radio station in a car radio. The user first sets the module to the hue desired by using the rotary knobs as previously described, and then presses and holds the desired preset key for over one second. Thereafter, depressing that preset key while in preset mode returns to the hue selected before setting that hue as a preset.

Each module of the present invention contains provisions for wirelessly communicating with other such modules. These modules use a peer-to-peer, master-less network protocol to communicate. This type of network is particularly appropriate for this application because of the simplicity of its architecture and operation. Existing wireless networking components for networks such as ZigBee® are used so that the wireless capability can be easily incorporated in the controller board used herein.

Any number of modules of the present invention may be networked with other of these modules. A network of such modules is called a "group". A group consists of two or more of these modules.

To establish a two module group, two modules must be in the "on" state. The "on-off" pushbutton 13 also serves as the "link" pushbutton, which adds the present module to other modules in the group.

With a first module in the "on" state, the user pushes the "link" pushbutton 13 on a second module and keeps it depressed for about 3 seconds. The two modules then form a group to which additional modules can be added in the same way as the second module was networked with the first module, as described above.

When a new module is added to the group, the existing modules' output will change to match the color of new module's output, to indicate that the group has been augmented.

When a group of modules has been established, every module in the group will respond to the controls of any module in the group. That is, every module in the group will have the same hue and intensity as every other module.

Referring again to FIG. 2, a group may be turned off by quickly depressing the "on-off" button. Removing a module from the group is accomplished by disconnecting power from the module. When powered back up again, the module will be independent of the group. A module thus removed from the group may be used independent of the group. Any number of independent modules may be used concurrently with an operating group of modules.

By use of the features just described, it is seen that the modules of the present invention provide flexibility, scalability, ease of use, and a range of intensities and hues not heretofore available. The modules are compact and provide ease of transportation, handling and storage as well.

Examples of additional embodiments of the present invention include, inter alia: using one conduit instead of two to provide electrical connections from light engine to control circuitry; integrating a battery pack within the electronics enclosure; the addition of push buttons for more color and white presets; connecting the light engine to the light engine connector board with plug-in connectors instead of soldering; integration of active or passive heat-tolerant circuitry on light engine connector board; addition of multiple-group capability, while retaining a master-less, peer-to-peer architecture within each group; and integration of optical-feedback circuitry to optically measure and adjust output in addition to temperature feedback.

The use of temperature feedback from the light engine is particularly useful, in that it can be used to maintain the relative intensities of the red, green, and blue lighting elements when the intensity controls are varied. The relative intensities of these colors are referred to herein as "ratiometric" parameters. Thus, the maintaining of these relative intensities are referred to herein as "maintaining ratiometric levels" of the red, green, and blue lighting elements. While the invention has been described in detail and with reference to specific embodiments thereof, it will be apparent to one skilled in the art that various changes and modifications can be made therein without departing from the spirit and scope thereof.

The invention claimed is:

1. A wirelessly controllable LED-based film and video production illumination system comprising:

(a) one or more light modules;

(b) each light module interconnectable by an incorporated wireless data network;

(c) each light module wirelessly controllable by any one of said light modules wirelessly interconnected on said wireless data network;

(d) each light module including a heat sink and a light engine containing an array of LEDs arranged to illuminate at least a portion of a subject of a film or video production;

(e) each light module including a control system electrically connected to said light engine;

(f) said control system adapted to adjust light output characteristics of said light engine;

(g) said control system further adapted to simultaneously adjust light output characteristics of light engines in every one of said light modules interconnected on said wireless data network;

(h) said control system on each of said light modules having manual input means and circuitry adapted to simultaneously adjust said light output characteristics of all of said light modules interconnected on said wireless data network so that manually adjusting light output characteristics on any one of said interconnected light modules causes all of said interconnected light modules to output light characteristics to match the light output characteristics produced by the light module for which said manual input means are used to manually wirelessly control all of said interconnected light modules; and (i) said manual input means comprises one or more rotary knobs.

2. The system of claim 1, wherein each light module comprises manual input means to add said light module to a group of wirelessly interconnected light modules.

3. The system of claim 2, wherein each light module comprises circuitry adapted to permit all light modules in said group to be controlled by using the control system of any one of said wirelessly interconnected light modules in said group.

4. The system of claim 1, wherein said light output characteristics comprise luminous intensity of light produced by said light engine, and said control system for adjusting said intensity further comprises said one or more rotary knobs.

5. The system of claim 1, wherein said light output characteristics comprise hue of light produced by said light engine, and the control system for adjusting said hue further comprises said one or more rotary knobs.

6. The system of claim 1, wherein said light output characteristics comprise hue of light produced by said light engine, and the control system further comprises one or more pushbuttons preset to hue parameters of said light module.

7. The system of claim 1, wherein said control system comprises circuitry adapted to provide a white mode and a color mode of operation of said light module.

8. The system of claim 7, wherein said light output characteristics comprise hue of light produced by said light engine, said control system further comprises one or more pushbuttons preset to hue parameters of said light module, and said hue parameters of each pushbutton have a first value when said light module is in said white mode of operation and a second value when said light module is in said color mode of operation.

9. The system of claim 1, wherein said control system comprises a rotary control of said light module that permits selecting sequential combinations of multiple color illumination levels of said light engine so as to generate a range of available light engine output colors, and said rotary control is adapted to permit repetitively cycling sequentially throughout said range of available colors by continuously rotating said rotary control in the same direction.

10. The system of claim 1, wherein said control system comprises circuitry adapted to allow the adjustment of a selected combination of multiple color illumination levels to collectively appear more white, thus producing pastel colors.

11. The system of claim 1, wherein said control system comprises circuitry adapted to detect a temperature of said light engine and, in response to said detected temperature, selectively adjust one or more color illumination levels of light produced by said light engine in order to maintain ratiometric levels of color illumination levels produced by said light engine.

* * * * *